United States Patent [19]

Vagarali et al.

[11] Patent Number: 5,022,894

[45] Date of Patent: Jun. 11, 1991

[54] DIAMOND COMPACTS FOR ROCK DRILLING AND MACHINING

[75] Inventors: Suresh S. Vagarali, Columbus; Bobby G. Hoyle, Worthington, both of Ohio

[73] Assignee: General Electric Company, Worthington, Ohio

[21] Appl. No.: 420,191

[22] Filed: Oct. 12, 1989

[51] Int. Cl.[5] ..... B24D 3/00

[52] U.S. Cl. ..... 51/293; 51/295; 51/309

[58] Field of Search ..... 51/293, 295, 309

[56] References Cited

U.S. PATENT DOCUMENTS

| | | | |
|---|---|---|---|
| Re. 32,380 | 7/1973 | Wentorf et al. | 407/119 |
| 4,063,909 | 12/1977 | Mitchell et al. | 51/309 R |
| 4,108,614 | 8/1978 | Mitchell | 51/295 |
| 4,311,490 | 1/1982 | Bovenkerk et al. | 51/293 |
| 4,403,015 | 9/1983 | Nakai et al. | 428/565 |
| 4,411,672 | 10/1983 | Ishizuka | 51/309 |
| 4,440,573 | 4/1984 | Ishizuka | 75/243 |
| 4,527,998 | 7/1985 | Knemeyer | 51/309 |
| 4,604,106 | 8/1986 | Hall et al. | 51/293 |
| 4,764,434 | 8/1988 | Aronsson et al. | 428/565 |
| 4,789,385 | 12/1988 | Dryer et al. | 51/293 |
| 4,875,907 | 10/1989 | Phaal et al. | 51/293 |
| 4,923,490 | 5/1990 | Johnson et al. | 51/295 |

FOREIGN PATENT DOCUMENTS

| | | |
|---|---|---|
| 0272081 | 6/1989 | European Pat. Off. . |
| 2024843 | 1/1980 | United Kingdom . |

*Primary Examiner*—William R. Dixon, Jr.
*Assistant Examiner*—Willie J. Thompson
*Attorney, Agent, or Firm*—Gary L. Loser

[57] ABSTRACT

There is provided a method for making diamond and CBN compacts which comprises positioning a catalyst metal disc and a barrier disc intermediate a diamond or CBN mass and a carbide mass. The catalyst metal disc is adjacent to the diamond or CBN layer and the barrier disc is intermediate said catalyst disc and the carbide mass. In order to prevent unregulated flow of metal bond from said carbide mass to the diamond layer and to prevent depletion of metal bond from the carbide near the carbide/diamond interface, the barrier disc has a surface area virtually identical to that of the carbide mass. Such arrangement of materials is subjected to temperature and pressure conditions within the diamond stable region but below the melting point of the barrier disc.

9 Claims, 1 Drawing Sheet

DIAMOND COMPACTS FOR ROCK DRILLING AND MACHINING

BACKGROUND OF THE INVENTION

Figure 1:
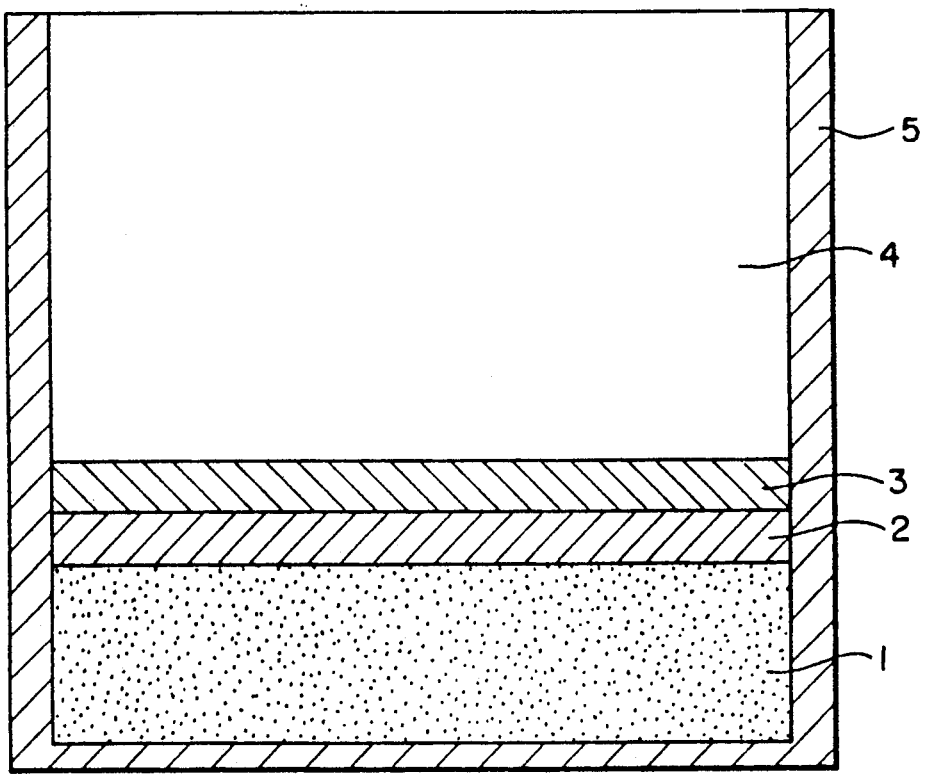

Field of the Invention: The present invention generally relates to abrasive compacts comprising a polycrystalline diamond layer and a cemented carbide support. More particularly, the present invention relates to a method for making such compacts which substantially eliminates cobalt depletion from the carbide support during high pressure/high temperature processing, and the products made thereby.

Prior Art: Polycrystalline diamond tools suitable for use in applications such as rock drilling and machining are well known in the art. U.S. Pat. No. Re.32,380 describes composite compacts comprising a polycrystalline diamond layer in which the diamond concentration is in excess of 70 volume percent and wherein substantially all of the diamond crystals are directly bonded to adjacent diamond crystals, and a cemented carbide support material which is considerably larger in volume that the volume of the polycrystalline diamond layer. Typically the carbide support is tungsten carbide containing cobalt metal as the cementing constituent.

The '380 patent teaches that the cobalt contained in the carbide support or carbide molding powder makes itself available to function both as the metal bond for sintering the carbide and as a diamond-making catalyst required for conversion of graphite to diamond. Although compacts made according to the process of the '380 patent are suitable for most purposes, the unregulated infiltration of cobalt from the carbide support into the diamond layer leaves an excessive amount of cobalt among the diamond particles, with the result that mechanical properties, particularly abrasion resistance, are less than optimal. Moreover, the physical and mechanical properties of the cemented carbide support near the diamond/carbide interface are reduced as a result of cobalt depletion from the carbide support.

It is possible to control cobalt depletion from the cemented carbide support to some extent by placing a thin cobalt metal disc between the diamond layer and the carbide support prior to high pressure/high temperature processing. However, this solution does not avoid the infiltration of excessive cobalt into the polycrystalline diamond layer of the composite compact and the resulting diminished mechanical properties.

One attempt to resolve these shortcomings is described in U.S. Pat. No. 4,411,672, which provides a composite compact by placing a pulverized diamond layer adjacent to a tungsten carbide/cobalt layer, and separating these layers with a metallic material which has a melting point lower than the eutectic point of the tungsten carbide/cobalt composition. The assembly is heated at a temperature high enough to permit melting of the metallic material but which is insufficient to cause substantial melting of the tungsten carbide/cobalt composition. In this way, a controlled amount of metal is introduced into the pulverized diamond to promote bonding.

U.S. Pat. No. 4,440,573 describes another means to control the amount of metal which infiltrates from the carbide support into the polycrystalline diamond layer. The method of the '573 patent involves providing a mass of diamond particles and a mass of infiltrant metallic material, each mass having a substantially identical surface area. The mass of diamond particles and mass of infiltrant metallic material are positioned such that the surfaces are separated by a barrier layer of high melting metal having a surface area of 85% to 97% of the surface areas of said masses of diamond particles and infiltrant metallic material. The thus positioned masses and barrier layer are subjected to temperature-pressure conditions within the diamond stable region but below the melting point of the metallic barrier layer. In this way, a regulated amount of molten infiltrant metal is allowed to flow around the barrier layer and throughout the mass of diamond particles.

U.S. Pat. No. 4,764,434 teaches that a thin continuous layer of titanium nitride applied by chemical vapor deposition or physical vapor deposition to the carbide support material is sufficient to prevent diffusion of cobalt into the diamond table and thereby prevent embrittlement of the surface of the carbide support nearest the diamond table. According to the '434 patent, such thin titanium nitride layer acts as an effective diffusion barrier, preventing depletion of binder metal, such as cobalt, from the cemented carbide support.

SUMMARY OF THE INVENTION

It is one object of the present invention to provide a method for making diamond compacts using conventional techniques which provides sufficient diamond-making catalyst to the polycrystalline diamond layer yet substantially eliminates depletion of cobalt from the cemented carbide support via infiltration into the diamond layer.

It is another object of the present invention to provide diamond compacts which exhibit improved mechanical properties, particularly abrasion resistance, but which do not suffer from cobalt depletion of the cemented carbide support.

In accordance with the foregoing objects, there are provided polycrystalline diamond/cemented carbide composite compacts prepared by positioning a catalyst metal disc over a mass of diamond particles, placing a metal barrier disc over said catalyst metal disc, and placing a cemented carbide mass or carbide molding powder over said metal barrier, wherein the surface area of the metal barrier and the cemented carbide mass or carbide molding powder are substantially identical. The thus arranged assembly is then subjected to temperature-pressure conditions within the diamond stable region of the carbon phase diagram but below the melting point of the metal barrier layer. Preferably, the support mass is cobalt cemented tungsten carbide, the catalyst metal disc is cobalt, and the metal barrier disc is tantalum.

THE DRAWING

FIG. 1 is a cross sectional view of a reaction cell subassembly for use within a high pressure/high temperature apparatus.

DESCRIPTION OF THE INVENTION

According to one aspect of the present invention there is provided a method for making abrasive compacts comprising providing a mass of diamond particles and a cemented carbide support or carbide molding powder, positioning a catalyst metal disc adjacent to the mass of diamond particles and a metal barrier disc intermediate said catalyst metal disc and the cemented carbide support or carbide molding powder, wherein the surface area of the metal barrier disc is substantially identical to the surface area of the cemented carbide support or carbide molding powder at their interface.

Referring to FIG. 1, the diamond particles 1 and cemented carbide support or carbide molding powder 4 are well known in the art, for example, as described in U.S. Pat. No. 32,380, assigned to the same assignee as the present invention and incorporated herein by reference. Diamond layer 1 is largely or completely made up of diamond particles which generally range from about 0.1 micron to about 500 microns in largest diameter. It is acceptable, though not preferred, to include minor quantities of graphite powder or carbide molding powder in addition to diamond particles in the diamond layer 1.

Cemented carbide support or carbide molding powder 4 preferably consists of a metal carbide selected from the group consisting of tungsten carbide, titanium carbide, tantalum carbide, molybdenum carbide, and mixtures thereof, with tungsten carbide being the most preferred. Other acceptable metal carbides will be apparent to those of ordinary skill in the art.

The bonding metal or cement of carbide support 4 is preferably selected from the group consisting of cobalt, nickel, iron and mixtures thereof, with cobalt being especially preferred in combination with tungsten carbide. The concentration of bonding metal utilized in the carbide support 4 of the present invention is not particularly limited and generally ranges from about 1% to about 16% by weight of the metal carbide.

Catalyst metal disc 2 can be made of any catalyst-solvent materials known in the diamond making art, for example, those disclosed in U.S. Pat. Nos. 2,947,609 and 2,947,610, both of which are incorporated herein by reference. Preferably, catalyst metal disc 2 is made of a metal selected from the group consisting of cobalt, nickel and iron, with cobalt being the most preferred. It is not critical that catalyst metal disc 2 extend over the entire adjacent surface area of diamond layer 1 although it is preferred that it do so. The thickness of metal disc 2 can be varied in order to regulate the amount of catalyst metal that will infiltrate into diamond layer 1. Generally, catalyst metal disc 2 will have a thickness of from about 0.0005 inch to about 0.005 inch, and preferably will be about 0.002 inch.

Metal barrier disc 3 can be any high melting metallic material such as tantalum, niobium, tungsten, titanium, molybdenum or other metallic material which exhibits such a high melting point as to not melt under the high pressure/high temperature conditions employed in the manufacture of diamond compacts. The thickness of metal barrier disc 3 is selected so that the sheet remains solid under processing conditions and generally ranges from 0.0005 inch to 0.005 inch, with about 0.002 inch being particularly preferred. It is critical to the invention that the surface area or cross section of metal barrier disc 3 be substantially identical to that of cemented carbide support or carbide molding powder 4. Generally this means that both barrier disc 3 and carbide mass 4 extend over the entire interior surface area of reaction cell 5. Such arrangement ensures that, for example, cobalt contained in carbide mass 4 cannot flow around metal barrier disc 3 into diamond layer 1.

In the production of diamond compacts according to the present invention, a cylindrical vessel or container 5 of tantalum, for example, is charged with a given amount of powdered diamond 1, a disc of catalyst metal 2 is placed over said diamond particles, a disc of barrier metal 3 is placed over said catalyst metal disc and extending over substantially the entire interior surface of said tantalum cup, and a cemented carbide support or carbide molding powder 4 is placed over barrier metal disc 3. Reaction vessel 5 is then mounted in a high pressure/high temperature apparatus and subjected to pressure-temperature conditions within the diamond stable region of the carbon phase diagram but below the melting point of the metal barrier disc 3. The resultant composite is removed from the apparatus and eventually further finished, for example, by grinding, to provide a diamond compact especially useful in rock drilling and machining applications.

Diamond compacts made in accordance with the present invention differ from prior art compacts in that a controlled amount of diamond-making catalyst is contained in diamond layer 1 after processing and, due to the presence of barrier layer 3, there is virtually no bonding metal depletion from carbide mass 4 near the carbide/diamond interface. Consequently, the diamond compacts of the present invention exhibit substantially improved mechanical properties, such as abrasion resistance, over prior art diamond compacts.

It is expected that the present invention is equally applicable to supported cubic boron nitride (CBN) compacts, for example, of the type described in U.S. Pat. No. 3,767,371, which is hereby incorporated by reference into the present disclosure.

In order to better enable those skilled in the art to practice the present invention, the following example is provided by way of illustration and not by way of limitation.

EXAMPLE 1

Diamond compacts of the present invention were made by charging about 0.650 gram of diamond particles having an average diameter of about 25 microns to a tantalum cup. A 0.002 inch thick cobalt disc was placed on top of the diamond particles and a 0.002 inch thick tantalum disc having substantially the same surface area as that of the tantalum reaction vessel was placed over the cobalt disc. A cobalt cemented tungsten carbide disc having a thickness of about 0.350 inch was then placed over the tantalum disc.

The reaction vessel was closed at each end with a tantalum plate and subjected to a combined condition of about 55 kb pressure and about 1400° temperature for about 15 minutes. Controls identical to the compacts of the present invention except that they contained no barrier disc were also prepared. The resultant diamond compacts were tested for abrasion resistance and impact resistance using Barre granite under standard test conditions. Abrasion resistance is measured as tool efficiency which is the ratio of volume of material removed versus tool wear area. Impact resistance is measured as the inverse of tool wear during the impact test. The results are provided in Table I.

TABLE I

| | Abrasion Test Results Tool Efficiency | | |
|---|---|---|---|
| | Average | Standard Deviation | Relative Abrasion Resistance, % |
| Control | 1946 | 299 | 100 |
| Experimental Product | 2360 | 314 | 121 |
| | Impact Test Results Tool Wear Area (sq. in.) | | |
| | | | Relative |

TABLE I-continued

| | Average | Standard Deviation | Impact Resistance, % |
|---|---|---|---|
| Control | 0.0071 | 0.0015 | 100 |
| Experimental Product | 0.0072 | 0.0015 | 99 |

These test results show that diamond compacts made in accordance with the present invention exhibit substantially better abrasion resistance than diamond compacts which do not contain a metal barrier disc without sacrificing their impact resistance. Further, the diamond compacts made in accordance with the present invention did not exhibit cobalt depletion in the carbide near the carbide/diamond interface.

EXAMPLE 2

Example 1 was repeated with 0.002" thick layer of niobium instead of a tantalum layer. These compacts also did not exhibit cobalt depletion in the carbide support near the diamond/carbide interface.

We claim:

1. A method for making diamond and cubic boron nitride compacts, comprising providing a mass of diamond or cubic boron nitride particles and a cemented carbide support or carbide molding powder; positioning a catalyst metal disc adjacent to the mass of diamond or cubic boron nitride particles and a metal barrier disc intermediate said catalyst metal disc and said cemented carbide support or carbide molding powder, wherein the surface area of said metal barrier disc is substantially identical to the surface area of said cemented carbide support or carbide molding powder at their interface; and subjecting such arrangement to temperature-pressure conditions within the diamond or cubic boron nitride stable region of the carbon or boron nitride phase diagram but below the melting point of said metal barrier disc.

2. The method of claim 1, wherein the cemented carbide support or carbide molding powder is selected from the group consisting of tungsten carbide, titanium carbide, tantalum carbide, molybdenum carbide and mixtures thereof.

3. The method of claim 2, wherein the cemented carbide support or carbide molding powder contains a bonding metal selected from the group consisting of cobalt, nickel and iron and mixtures thereof.

4. The method of claim 1, wherein the catalyst metal disc is made of a metal selected from the group consisting of cobalt, nickel and iron.

5. The method of claim 4, wherein the catalyst metal disc has a thickness of from about 0.0005 inch to about 0.005 inch.

6. The method of claim 1, wherein the metal barrier disc is made of a metal selected from the group consisting of tantalum, niobium, tungsten, titanium and molybdenum.

7. The method of claim 6, wherein the metal barrier disc has a thickness of from about 0.0005 inch to about 0.005 inch.

8. In a method of making diamond or cubic boron nitride compacts comprising the steps of positioning a catalyst metal disc between a mass of diamond or cubic boron nitride particles and a cemented carbide support or carbide molding powder and subjecting such arrangement of diamond or cubic boron nitride particles, catalyst metal disc and cemented carbide support or carbide molding powder to temperature-pressure conditions within the diamond or cubic boron nitride stable region of the carbon or boron nitride phase diagram, the improvement consisting essentially of positioning a metal barrier disc intermediate said catalyst metal disc and said cemented carbide support or carbide molding powder, wherein the #surface area of said metal barrier disc is substantially identical to the surface area of said cemented carbide support or carbide molding powder and wherein the temperature-pressure conditions to which such arrangement is subjected are insufficient to melt said metal barrier disc.

9. A diamond or cubic boron nitride compact manufactured by a process comprising providing a mass of diamond or cubic boron nitride particles and a cemented carbide support or carbide molding powder; positioning a catalyst metal disc adjacent to the mass of diamond or cubic boron nitride particles and a metal barrier disc intermediate said catalyst metal disc and said cemented carbide support or carbide molding powder, wherein the surface area of said metal barrier disc is substantially identical to the surface area of said cemented carbide support or carbide molding powder at their interface; and subjecting such arrangement of diamond or cubic boron nitride particles, cemented carbide support or carbide molding powder, metal catalyst disc and metal barrier disc to temperature-pressure conditions within the diamond or cubic boron nitride stable region of the carbon or boron nitride phase diagram but below the melting point of said metal barrier disc.

* * * * *